US009347454B2

(12) United States Patent
Serbruyns

(10) Patent No.: US 9,347,454 B2
(45) Date of Patent: May 24, 2016

(54) METHOD FOR CONTROLLING A TURBOCOMPRESSOR

(75) Inventor: Sven Bert Serbruyns, Gavere (BE)

(73) Assignee: ATLAS COPCO AIRPOWER, NAAMLOZE VENNOOTSCHAP, Wilrijk (BE)

( * ) Notice: Subject to any disclaimer, the term of this patent is extended or adjusted under 35 U.S.C. 154(b) by 1803 days.

(21) Appl. No.: 12/522,695

(22) PCT Filed: May 7, 2008

(86) PCT No.: PCT/BE2008/000038
§ 371 (c)(1),
(2), (4) Date: Jul. 9, 2009

(87) PCT Pub. No.: WO2008/138075
PCT Pub. Date: Nov. 20, 2008

(65) Prior Publication Data

US 2010/0074725 A1 Mar. 25, 2010

(30) Foreign Application Priority Data

May 15, 2007 (BE) ..... 2007/0238

(51) Int. Cl.
*F04B 49/02* (2006.01)
*F04D 27/02* (2006.01)

(52) U.S. Cl.
CPC ..... *F04D 27/0292* (2013.01); *F04D 27/0261* (2013.01)

(58) Field of Classification Search
CPC ..... F04D 27/0292; F04D 27/0261
USPC ..... 417/17, 18, 19, 20, 42, 326, 9; 60/597; 123/559.1
See application file for complete search history.

(56) References Cited

U.S. PATENT DOCUMENTS

| | | | | |
|---|---|---|---|---|
| 2,929,547 | A * | 3/1960 | Koffel | 417/17 |
| 4,640,665 | A | 2/1987 | Staroselsky et al. | |
| 5,224,836 | A * | 7/1993 | Gunn et al. | 417/14 |
| 5,967,742 | A * | 10/1999 | Mirsky et al. | 415/1 |

FOREIGN PATENT DOCUMENTS

| | | | |
|---|---|---|---|
| JP | S63-223396 | A | 9/1988 |
| JP | S64-019200 | A | 1/1989 |
| JP | 04-358798 | A | 12/1992 |
| JP | H11-117894 | A | 4/1999 |
| JP | H11-303792 | A | 11/1999 |
| JP | 2000-234598 | A | 8/2000 |
| JP | 2005-016464 | A | 1/2005 |
| UA | 5427 | U | 3/2005 |

* cited by examiner

*Primary Examiner* — Patrick Hamo
(74) *Attorney, Agent, or Firm* — Bacon & Thomas, PLLC

(57) ABSTRACT

Method for controlling a turbocompressor, whereby a compressed air line (5) is connected to this turbocompressor (1) with a non-return valve (6) provided therein, characterised in that, when one or several process parameters exceed a predetermined limit, the rotational speed of the turbocompressor (1) will be reduced very suddenly to a predetermined minimum rotational speed and the above-mentioned non-return valve (6) will be closed and in that, after the above-mentioned reduction of the rotational speed, when one or several gear-down conditions are fulfilled, the rotational speed of the compressor (1) will be increased again and the non-return valve (6) will be opened.

13 Claims, 1 Drawing Sheet

METHOD FOR CONTROLLING A TURBOCOMPRESSOR

Figure 1:
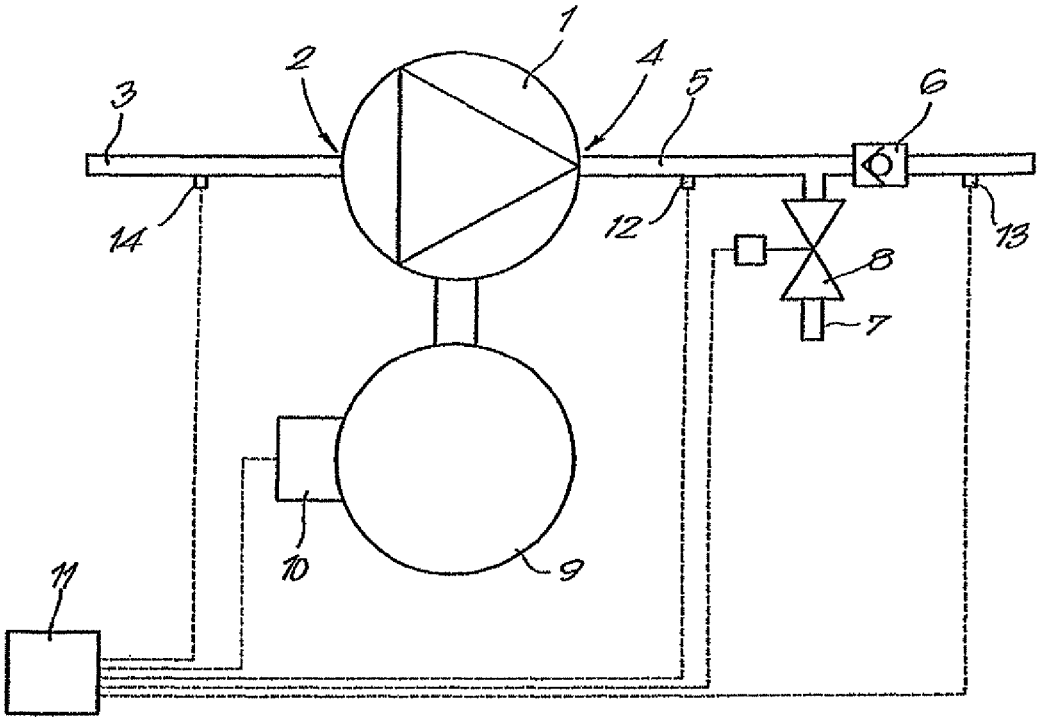

The present invention concerns a method for controlling a turbocompressor.

As is known, a turbocompressor consists of a rotor with vanes provided in a rotating manner in a housing with an axial inlet and, depending on the type of turbocompressor, an axial or radial outlet.

while the rotor is being driven, air or another gas is axially sucked in by the compressor via the inlet and pressed out via the outlet.

The gas is hereby compressed thanks to the balance of the centrifugal forces and the transformation of kinetic energy into pressure.

For an operation in the normal working area, different adjusting techniques are already known, such as the application of adjustable inlet vanes whose position can be altered as a function of the desired gas flow in order to be able to bend off the gas flow rate at the inlet of the compressor.

It is also already known to provide the turbocompressor with adjustable diffusion vanes whose position can be adjusted as a function of the desired gas flow rate, in an analogous way as described above in relation to the inlet vanes.

Other known adjusting methods consist for example of adjusting the rotational speed of the compressor, throttling the air inlet of the compressor or a combination of two or more of the aforesaid adjusting techniques.

With all these known methods, a certain minimum flow rate has to be supplied by the compressor for a certain outlet pressure, whereby this minimum flow rate is different for every method.

For continuous flow rate values that are lower than said minimum flow rate, a stable operation is no longer possible, and the compression will suffer from a phenomenon called "surge", whereby the entire compressor system becomes unstable with violent changes in the inlet and outlet conditions, which also has an effect on the pressure ratio and the output. This unstable, abnormal flow results in major mechanical forces which may damage the machine in this area when it is running continuously.

If the pressure or pressure ratio is sufficiently low, the resulting mechanical forces will be smaller, such that they can be permanently absorbed by the machine when running continuously.

If this is represented in a graph for different pressure values, one obtains a series of minimum flows situated on a common curve, namely the surge curve.

If the minimum flow rate is plotted as a function of the pressure, whereby the pressure is represented by the vertical, upward directed axis, and the minimum flow rate by the horizontal axis directed to the right, the unstable adjusting area will be situated to the left of the surge curve.

In practice, a "surge control curve" is usually used which is obtained by shifting the above-mentioned graph to the right, such that a safety margin is obtained. If the aforesaid margin is set equal to zero, the surge control curve and the surge curve will coincide.

If the flow rate required for a process is smaller at a certain pressure value than the minimum flow rate which is represented by the surge control curve, a method will have to be introduced which first of all secures the compressor against the effects of the surge and which secondly makes it possible to supply such a low flow rate to the process.

In order to supply such low flow rates in the unstable adjusting area or the surge area, several methods are already known, including the following ones.

A first known method consists in applying an open/closed exhaust valve which makes it possible, as soon as the flow rate in the compressor drops to a minimum value, determined by the surge control curve, to blow off an amount of compressed gas at the outlet of the compressor into the atmosphere. The adjusting parts such as the inlet vanes and the like are hereby no longer varied.

At the same time, a non-return valve provided in the compressed air line of the compressor will be closed, such that the compressor is isolated from the process and, as a consequence, no flow rate is supplied to the process.

As a result, a flow rate will flow through the compressor which is bigger than the above-mentioned minimum value, such that surge is avoided.

By subsequently closing the exhaust valve again, the non-return valve will open again, whereupon the compressor will supply flow rate to the process again.

As a result of the alternating opening and closing of the exhaust valve, the required flow rate can on average be supplied to the process.

A major disadvantage of this method is that the entire air or gas flow rate is discharged via the exhaust valve, resulting in a large energy loss.

Another known method consist in the application of a modulating exhaust valve, whereby, when the surge control curve is reached, the exhaust valve is only partly opened and whereby the position of the exhaust valve is continuously adjusted, such that the appropriate flow rate can be supplied.

Consequently, in this method as well, a certain amount of fluid is blown off by the exhaust valve and is thus lost, producing an amount of energy loss.

A third known method is an expansion of the first method, whereby in this case, apart from opening an exhaust valve and closing the non-return valve, geometry-adjusting parts such as the inlet vanes, the diffusion vanes and the like are put in such a position that the compressor flow rate is small and no flow rate will be supplied to the process by closing the non-return valve.

In this method, however, the compressor keeps running at the design rotational speed, as a result of which the losses, which predominantly occur in the drive system, are large and easily amount to fifteen to twenty percent of the rated power.

In order to be able to supply flow rate to the process again, the geometry-adjusting parts are put back in the direction of their original position, and the exhaust valve is closed, whereupon the non-return valve opens again.

By alternating these cycles, the desired flow rate can on average be supplied to the process.

The blown-off flow rate is considerably smaller with this method than with the first method, as a result of which there are less losses. The total losses remain significant, however, since the compressor keeps running at the design rotational speed.

The present invention aims to remedy one or several of the above-mentioned and other disadvantages.

To this end, the present invention concerns a method for adjusting a turbocompressor, whereby a compressed air line is connected to this turbocompressor with a non-return valve in it, and whereby, when one or several process parameters exceed a pre-determined limit, the rotational speed of the turbocompressor will be reduced in a very sudden manner to a predetermined minimum rotational speed, and the above-mentioned non-return valve will be closed, and whereby, after the above-mentioned reduction of the rotational speed, if one or several gear-down conditions are fulfilled, the rotational speed of the compressor will be increased again and the non-return valve will open.

An advantage of this method is that, as the compressor turns but at a minimum rotational speed, it consumes only a very limited compressor power. Thanks to this low rotational speed, the losses in the drive are considerably lower than in case of a nominal operation, such that the power required in this condition is only a fraction of the nominal power.

Another advantage of such a method according to the invention is that the compressor is always ready, in case of a suddenly increasing take-off flow rate, to switch quickly back into the first operating condition by forcing up the rotational speed again.

This method also allows for an adjustment without hereby necessarily having to blow off an amount of the gas or compressed air flow rate into the atmosphere.

With the aforesaid method according to the invention, there is the possibility for the compressor to turn in surge during the transient phenomenon occurring when the rotational speed of the turbocompressor is reduced very suddenly and the non-return valve is sealed.

As is known, the occurrence of such a "surge event" results in an additional mechanical load.

Therefore, the machine must be designed such that it can resist this temporary additional load without suffering any damage.

When it turns at reduced rotational speed and with a closed non-return valve, the compressor will be continuously in surge.

In this case, however, the mechanical load will be low, such that this does not entail any considerable problems. If necessary, it is always possible to take measurements to avoid temperature rises.

According to a preferred characteristic of the invention, however, combined with the sudden reduction of the rotational speed, an amount of compressed gas will be diverted as well and/or blown into the atmosphere in order to prevent any backflow.

This is advantageous in that the pressure ratio over the compressor is very low, as a result of which the consumed compressor power drops even further and additional energy is saved.

Another advantage of such a method is that the gas to be diverted and/or to be blown off is at a much lower pressure than the process pressure, resulting in a lower loss of energy.

Moreover, the amount of diverted and/or blown-off air or gas can be more restricted than with the known methods, such that the accompanying losses are restricted, given the small blow-off flow rate and given the low compression ratio.

By extension, such a method according to the invention can also be applied to a multi-stage compressor formed of several compressor stages.

We distinguish the following cases here:

1) several compressor stages are driven by a single motor; or
2) several compressor stages are driven by several motors (the number of motors being smaller than or equal to the number of compressor stages). The nominal as well as the reduced rotational speed of these motors is in this case not necessarily the same and the sudden reductions of the rotational speeds of the different above-mentioned motors may either or not occur simultaneously.

In either of the two cases mentioned above, one or several exhaust valves may be provided between the different compressor stages and/or after the final compressor stage.

Figure 2:
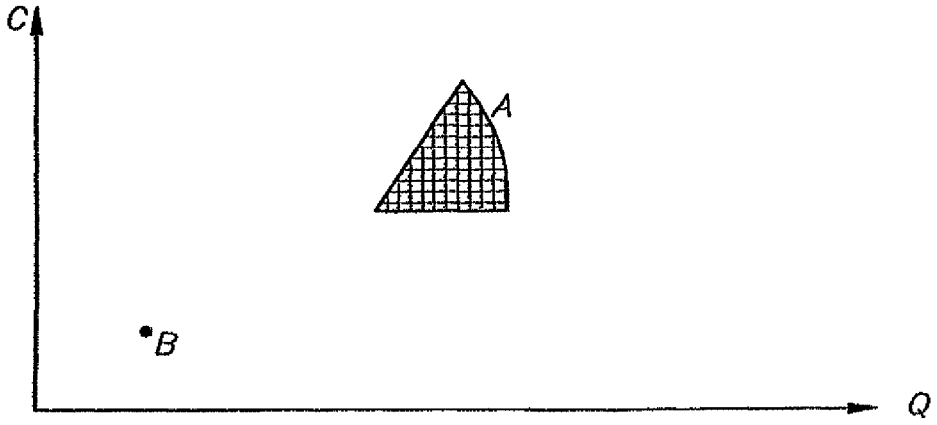

In order to better explain the characteristics of the invention, the following preferred method according to the invention is described as an example only without being limitative in any way, with reference to the accompanying drawings, in which:

FIG. 1 schematically represents a compressor driven according to a method of the invention;

FIG. 2 represents the working principle of the method according to the invention in a diagram.

FIG. 1 represents a turbocompressor 1 with a suction side 2 onto which is connected a suction line 3, and a delivery side 4 onto which is connected a compressed air line 5, and whereby a non-return valve 6 is provided in this compressed air line 5 which prevents a flow towards the turbocompressor 1.

The above-mentioned non-return valve 6 is in this case built in the conventional manner with a spring pressing a sealing element against a seating, but it is not excluded according to the invention for this non-return valve 6 to be realised in other ways, such as in the shape of a controlled valve or the like.

Onto the above-mentioned compressed air line 5, between the turbocompressor 1 and the above-mentioned non-return valve 6, is also connected an exhaust line 7 with an exhaust valve 8.

The exhaust valve 8 is in this case made in the shape of a controllable valve with an adjustable position, but the latter is not necessary according to the invention, however.

The compressor 1 is driven by a motor 9 which is in this case made as an electric, speed-controlled motor 9 with a control module 10, but which can also be made in the shape of any other type of motor, for example a thermal motor.

Further, the compressor 1 is in this case provided with a controller 11, for example in the shape of a PLC or the like, which is at least connected to the above-mentioned control module 10, but which is in this case also connected to the exhaust valve 8.

The compressor is also provided with a first pressure reader 12 provided in the compressed air line 5, between the compressor 1 and the non-return valve 6, and a second pressure reader 13 which is also provided in the compressed air line 5, past the above-mentioned non-return valve 6, such that this second pressure reader 13 measures the pressure prevailing in the compressed air network or in the process being fed via this compressed air line 5.

Finally, the compressor 1 in this example also includes a flow rate reader 14 which is in this case provided in the suction line 3.

Each of the readers 12 to 14 is connected to the above-mentioned controller 11.

The method according to the invention is very simple and as follows.

Under stable working conditions, in other words outside the surge area, i.e. in the normal working zone as illustrated by means of the shaded zone A in the diagram of FIG. 2, the turbocompressor 1 is preferably adjusted by controlling the speed of the motor 9 and thus the rotational speed of the compressor.

The vertical axis in the graph of FIG. 2 represents the compression ratio c over the turbocompressor 1, whereas the horizontal axis represents the compressor flow rate q.

According to the invention, as soon as one or several process parameters exceed a predetermined limit, the rotational speed of the turbocompressor 1 will be very suddenly reduced to a predetermined minimum rotational speed, and the above-mentioned non-return valve 6 will be closed.

In this example, when the flow rate as measured by the flow rate reader 14 drops to or beneath a predetermined minimum flow rate value corresponding to the surge control curve, the rotational speed of the turbocompressor 1 will be reduced very suddenly to a predetermined minimum rotational speed according to the invention, as represented in the diagram of FIG. 2 by the operational point B, outside the normal working zone A.

The above-mentioned minimum flow rate value and the minimal rotational speed can hereby be stored for example in the above-mentioned controller 11 and can be determined experimentally for example to obtain the best results.

According to a preferred characteristic of a method according to the invention, combined with the sudden reduction of the rotational speed and the sealing of the non-return valve 6, the exhaust valve 8 is opened, such that the compressor 1 is isolated from the process.

As the compressor 1 turns at a very low rotational speed while the exhaust valve 8 is open, the pressure ratio over the compressor 1 is low and the compressor 1 consumes only a limited compressor power.

Thanks to the low rotational speed, the losses occurring for example in the bearings of the motor 9 and the compressor 1 and in the possible transmission between the motor 9 and the compressor 1 are much smaller than in nominal operation.

The conditions under which the normal operating conditions are reassumed, in other words under which the rotational speed of the compressor is increased again and the exhaust valve 8 is sealed, whereas the non-return valve opens again due to the increasing pressure on the compressor side of said non-return valve 6, are programmed in the controller 11 as well.

An example of such a switch-back condition may be for example that the pressure value of the process or the compressed air network, measured by the second pressure reader 13, drops under a certain value.

According to a special characteristic of the invention, the exhaust valve 8 may be adjustable between a number of different positions, or said exhaust valve 8 may even be adjustable in a continuously variable manner, such that, when the measured flow rate drops to the above-mentioned minimum flow rate value, said exhaust valve 8 is first opened in a controlled manner by means of a modulating control.

Should a stop condition occur in this case, for example when a predetermined opening of the exhaust valve 8 is reached, the above-mentioned steps of the method according to the invention may start, namely the sudden reduction of the rotational speed, the opening of the exhaust valve 8 and the closing of the non-return valve 6.

According to the invention, it is not excluded for the above-mentioned method to be combined with the application of adjustable inlet vanes, adjustable diffusion vanes, throttling the suction line or other adjusting means making it possible to adjust the supplied compressor flow rate.

In the above-described example, use is made of an exhaust valve 8, but the presence of such an exhaust valve is not strictly necessary and it can be omitted or combined and/or replaced by a return line to divert an amount of compressed gas.

The present invention can be applied to all types of turbocompressors, i.e. on axial as well as on radial turbocompressors.

According to a special characteristic of the invention, the above-mentioned compressor 1 is composed of several compressor stages, whereby these compressor stages are either:

a) driven by a single motor; or b) are driven by several motors, either or not having the same nominal and reduced rotational speed values.

In the latter case, when there are several motors, the rotational speed of the different above-mentioned motors can be either or not simultaneously reduced.

If required, in each of the above-mentioned cases a) and b), one or several exhaust valves can be provided between the different compressor stages and/or after the final compressor stage.

The present invention is by no means restricted to the method described as an example and represented in the drawings; on the contrary, such a method according to the invention can be made in many ways while still remaining within the scope of the invention.

The invention claimed is:

1. Method for controlling a turbocompressor, comprising the steps:

connecting a compressed air line with a non-return valve provided therein to a turbo compressor;

when one or several process parameters exceed a predetermined limit, reducing the rotational speed of the turbocompressor very suddenly to a predetermined minimum rotational speed and closing the non-return valve;

after the reduction of the rotational speed, when one or several gear-down conditions are fulfilled, increasing the rotational speed of the compressor and opening the non-return valve.

2. A method for controlling a turbocompressor, comprising the steps:

connecting a compressed air line with a non-return valve provided therein to a turbo compressor;

when one or several process parameters exceed a predetermined limit, reducing the rotational speed of the turbocompressor very suddenly to a predetermined minimum rotational speed and closing the non-return valve;

after the reduction of the rotational speed, when a predetermined minimum pressure value at the outlet of the compressor is reached, increasing the rotational speed of the compressor and opening the non-return valve.

3. The method according to claim 2, wherein, under stable working conditions, one or several of the following control techniques is applied:

controlling adjustable inlet vanes that are provided in the compressor;

controlling adjustable diffusion vanes that are provided in the compressor;

throttling a suction line of the compressor.

4. The method according to claim 2, wherein, combined with suddenly reducing the rotational speed of the compressor, an amount of compressed gas is diverted and/or blown off into the atmosphere so as to prevent any backflow.

5. The method according to claim 2, including, under stable working conditions, driving the turbocompressor by adjusting the rotational speed.

6. The method according to claim 2, wherein use is made of a variable exhaust valve which, when the flow rate supplied by the compressor drops under a minimum flow rate value, is opened in a controlled manner first via a modulating control until a certain stop condition is reached, and then in a manner to cause sudden reduction of the rotational speed of the compressor.

7. Method according to claim 6, wherein the stop condition comprises reaching a preset opening of the exhaust valve.

8. The method according to claim 2, wherein the compressor comprises several compressor stages, driven by a single motor.

9. The method according to claim 2, wherein the compressor comprises several compressor stages that are driven by several motors having the same nominal and reduced rotational speed values.

10. Method according to claim 9, wherein the reduction of the rotational speed of the different motors occurs simultaneously.

11. Method according to claim 9, wherein the reduction of the rotational speed of the different motors does not occur simultaneously.

12. Method according to claim 8, wherein one or several exhaust valves are provided between different compressor stages and/or after a final compressor stage.

13. A method for controlling a turbocompressor, comprising the steps:

connecting a compressed air line with a non-return valve provided therein to a turbo compressor;

when one or several process parameters exceed a predetermined limit, reducing the rotational speed of the turbocompressor very suddenly to a predetermined minimum rotational speed and closing the non-return valve;

after the reduction of the rotational speed, when a predetermined minimum pressure value at the outlet of the compressor is reached, increasing the rotational speed of the compressor and opening the non-return valve, wherein the compressor comprises several compressor stages.

* * * * *